US008948674B2

(12) United States Patent
Kodera

(10) Patent No.: US 8,948,674 B2
(45) Date of Patent: Feb. 3, 2015

(54) FIXING DEVICE

(71) Applicant: Fuji Xerox Co., Ltd., Tokyo (JP)

(72) Inventor: Tetsuro Kodera, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/064,529

(22) Filed: Oct. 28, 2013

(65) Prior Publication Data

US 2014/0241765 A1 Aug. 28, 2014

(30) Foreign Application Priority Data

Feb. 22, 2013 (JP) ..... 2013-032987

(51) Int. Cl.
*G03G 15/20* (2006.01)

(52) U.S. Cl.
CPC ..... *G03G 15/2007* (2013.01); *G03G 15/201* (2013.01); *G03G 2215/2032* (2013.01)
USPC ..... 399/336; 399/329

(58) Field of Classification Search
CPC ..... G03G 15/2007
USPC ..... 399/329, 336, 338
See application file for complete search history.

(56) References Cited

U.S. PATENT DOCUMENTS

| | | | | |
|---|---|---|---|---|
| 5,436,710 | A | 7/1995 | Uchiyama | |
| 5,459,561 | A * | 10/1995 | Ingram | 399/336 |
| 2011/0058869 | A1 * | 3/2011 | Kagawa | 399/336 |
| 2011/0064448 | A1 * | 3/2011 | Watanabe et al. | 399/336 X |

FOREIGN PATENT DOCUMENTS

| | | |
|---|---|---|
| JP | A-6-301304 | 10/1994 |
| JP | A-2011-128223 | 6/2011 |

* cited by examiner

*Primary Examiner* — Sandra Brase
(74) *Attorney, Agent, or Firm* — Oliff PLC

(57) ABSTRACT

Provided is a fixing device including a transparent belt, a press roller that is rotated with being opposed to and contacting with the transparent belt, and transports a recording medium interposed therebetween, a press member-cum-optical system that contacts with the transparent belt from an opposite side to the press roller, forms a press region for pressing a toner image formed on the recording medium in cooperation with the press roller during transport of the recording medium, and collects laser light on the toner image in the press region in a transport direction of the recording medium, and a laser light irradiation unit that irradiates the press member-cum-optical system with laser light.

11 Claims, 5 Drawing Sheets

FIXING DEVICE

CROSS-REFERENCE TO RELATED APPLICATIONS

This application is based on and claims priority under 35 USC 119 from Japanese Patent Application No. 2013-032987 filed Feb. 22, 2013.

BACKGROUND

The present invention relates to a fixing device.

SUMMARY

According to an aspect of the invention, there is provided a fixing device including:

a transparent belt;

a press roller that is rotated with being opposed to and contacting with the transparent belt, and transports a recording medium interposed therebetween;

a press member-cum-optical system that contacts with the transparent belt from an opposite side to the press roller, forms a press region for pressing a toner image formed on the recording medium in cooperation with the press roller during transport of the recording medium, and collects laser light on the toner image in the press region in a transport direction of the recording medium; and a laser light irradiation unit that irradiates the press member-cum-optical system with laser light.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the present invention will be described with reference to the drawings.

Figure 1:
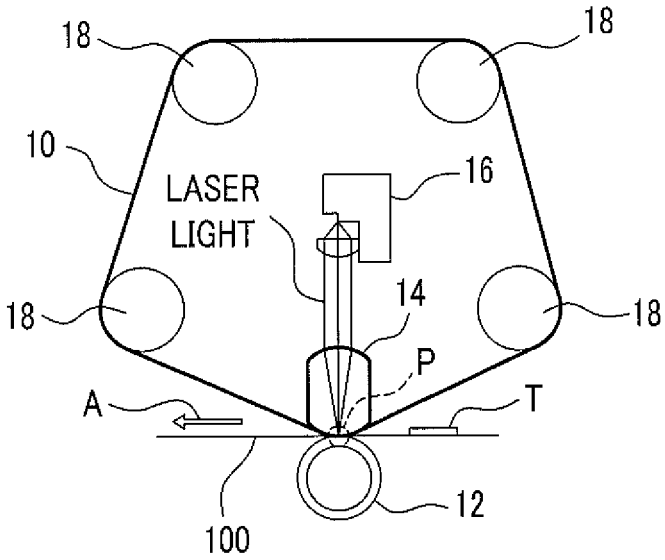
FIG. 1 is a diagram illustrating a configuration example of a fixing device according to an exemplary embodiment.

FIG. 1 shows a configuration example of a fixing device according to an exemplary embodiment. In FIG. 1, the fixing device includes a transparent belt 10, a press roller 12, a press member-cum-optical system 14, and a laser light irradiation unit 16.

The transparent belt 10 is hung on plural support rollers 18 and forms an appropriate track. In addition, in the example of FIG. 1, four support rollers 18 are shown, but the number thereof is not limited thereto, and an appropriate number of support rollers 18 may be used. Further, at least one of the support rollers 18 also functions as a driving roller which rotates and moves the transparent belt 10 along the track.

The press roller 12 that is opposite to and contacts with the transparent belt 10, is rotated and transports a recording medium 100 interposed therebetween. In the example of FIG. 1, the transparent belt 10 and the press roller 12 are driven and are rotated so as to transport the recording medium 100 in the arrow A direction. Materials forming the press roller 12 may include, for example, aluminum, stainless steel, a copper sheet plated with nickel or the like, and the like. In addition, the press roller 12 may have a configuration in which a coolant is made to flow through the inside thereof so as to cool the press roller and the transparent belt 10.

The press member-cum-optical system 14 contacts with the transparent belt 10 from an opposite side to the press roller 12, and forms a press region P for pressing a toner image T formed on the recording medium 100 during transport of the recording medium 100 in cooperation with the press roller 12. The press member-cum-optical system 14 collects laser light emitted from the laser light irradiation unit 16 in the press region P in the transport direction of the recording medium 100 so as to irradiate the toner image T. Here, the phrase "laser light is collected in the transport direction" indicates that a width of the laser light is reduced in the transport direction (the arrow A direction) of the recording medium 100 and in the direction opposite thereto by 180 degrees. In this case, the laser light maintains its width in the direction perpendicular to the arrow A so as to heat the toner image T formed on the recording medium 100. The press member-cum-optical system 14 according to the present exemplary embodiment collects and applies laser light on and to the toner image T while pressing the toner image T in the press region P, such that a position of the toner image T conforms to a position where the laser light is collected at all times.

The laser light irradiation unit 16 may have any configuration as long as laser light can be generated. In addition, in the example of FIG. 1, the laser light irradiation unit 16 is disposed inside the track of the transparent belt 10, but the exemplary embodiment is not limited thereto, and the laser light irradiation unit 16 may be disposed outside the track of the transparent belt 10.

Figure 2:
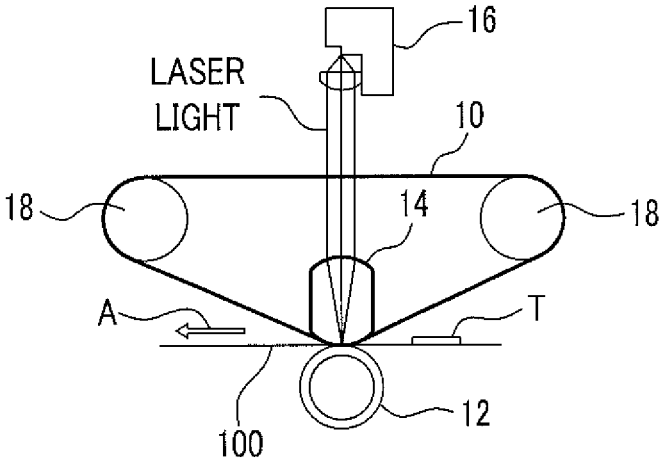
FIG. 2 is a diagram illustrating another configuration example of the fixing device according to the exemplary embodiment.

FIG. 2 shows another configuration example of the fixing device according to the present exemplary embodiment. In the example of FIG. 2, two support rollers 18 are used, and the transparent belt 10 is hung between the two support rollers 18 and is slid on the press member-cum-optical system 14. The laser light irradiation unit 16 in this example is disposed outside the track of the transparent belt 10, and laser light emitted from the laser light irradiation unit 16 passes through the transparent belt 10 and is then incident to the press member-cum-optical system 14 so as to be collected on the toner image T.

Figure 3:
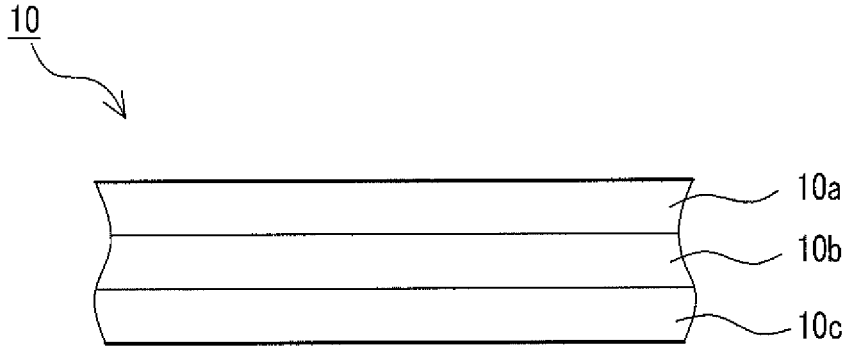
FIG. 3 is a cross-sectional view of a transparent belt according to the exemplary embodiment.

FIG. 3 is a cross-sectional view of the transparent belt 10. In the example of FIG. 3, the transparent belt 10 has a three-layer structure, and is formed of a base material layer 10*a*, an elastic layer 10*b*, and a release layer 10*c*. In addition, the transparent belt 10 is not limited to the three-layer structure and may have appropriate layers according to functions thereof.

In FIG. 3, the base material layer 10*a* is made of silicone such as polyvinylidene fluoride (PVDF), polyimide (PI), polyethylene (PE), polyurethane (PU), or polydimethylsiloxane (PDMS), or a material selected from the group consisting of polyetheretherketone (PEEK), polyether sulfone (PES), fluorinated ethylene propylene (FEP), ethylene tetrafluoroethylene copolymer (ETFE), chlorotrifluoroethylene (CTFE), polyvinylidene fluoride (PVDF), polyvinyl fluoride (PVF), polytetrafluoroethylene (PTFE), and mixtures thereof.

In addition, the elastic layer 10*b* is made of LSR silicone rubber, HTV silicone rubber, RTV silicone rubber, or the like, and transmits laser light therethrough and has elasticity to absorb concaves and convexes of a sheet or a step difference of the toner image T.

Further, the release layer 10*c* is made of a fluorine resin such as, for example, polytetrafluoroethylene (PTFE), perfluoroalkoxyethylene (PFA), fluorinated ethylene/propylene (FEP), or the like, and transmits laser light therethrough and facilitates the release of the transparent belt 10 and the toner image T formed on the recording medium 100.

In addition, the release layer 10*c* also has a function of giving a desirable gloss to a fixed image in cooperation with the elastic layer 10*b*.

In the transparent belt 10 with the configuration shown in FIG. 3, the release layer 10*c* contacts with the recording medium 100 on which the toner image T is formed. In addition, the laser light is incident from the base material layer 10*a* side and is applied to the toner image T from the release layer 10*c* side.

In addition, the term "transparent" described here indicates that the transparency in a wavelength range of the laser light is considerably high. Specifically, any transparent belt may be used as long as laser light emitted from the laser light irradiation unit 16 is transmitted therethrough, and, for example, in a case where laser light emitted from the laser light irradiation unit 16 is infrared light, there is no problem even if the laser light is absorbed in a visible region. In consideration of light use efficiency, the press member-cum-optical system 14 being heated, or the like, the higher (for example, 90% or more, and, preferably 95% or more) the transparency, the better the transparent belt.

Figure 4:
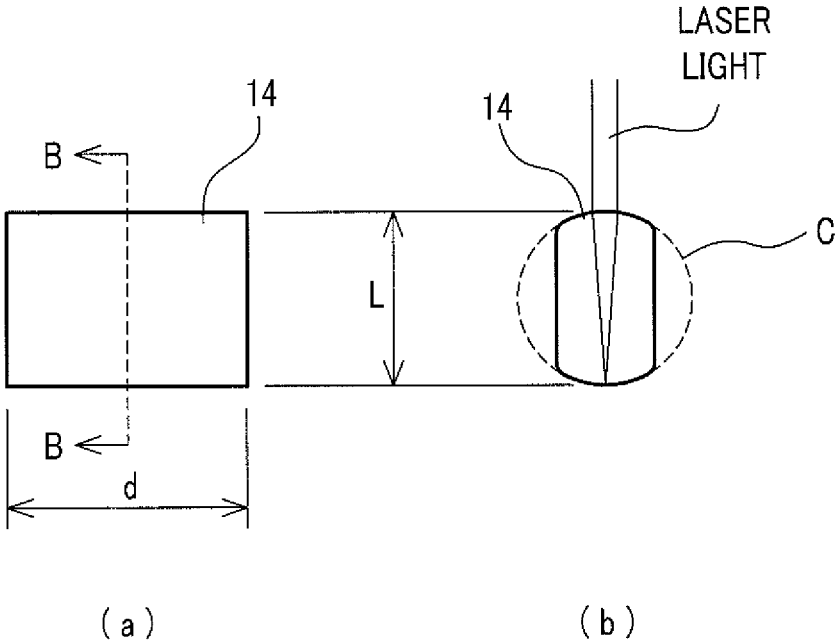
FIG. 4 is a diagram illustrating an example of a shape of a press member-cum-optical system according to the exemplary embodiment.

In (a) and (b) of FIG. 4, an example of a shape of the press member-cum-optical system 14 is shown. (a) of FIG. 4 is a plan view, and (b) of FIG. 4 is a cross-sectional view taken along the line B-B in (a) of FIG. 4 (a cross-sectional view which is parallel to the transport direction (the arrow A direction of FIG. 1) of the recording medium 100 and is perpendicular to the transport surface of the transparent belt 10). In (a) of FIG. 4, the width d of the press member-cum-optical system 14 is a length which is required to irradiate the toner image T formed on the recording medium 100 with laser light. In addition, the laser light irradiation unit 16 may supply laser light with the width d to the press member-cum-optical system 14.

Further, as shown in (b) of FIG. 4, the cross-section of the press member-cum-optical system 14 has a laser light incidence surface and a laser light emission surface which are formed in a circular shape (a part of the circle C). Furthermore, the length L in the traveling direction of laser light of the press member-cum-optical system 14 is adjusted such that a laser light collection position is formed on the toner image T which is located further outward than the laser light emission surface by the thickness of the transparent belt 10.

For example, in a case where a refractive index of a material forming the press member-cum-optical system 14 is 1.5, a laser light collection position is a position which is more distant from the laser light incidence surface than the diameter of the circle C forming the laser light incidence surface and the laser light emission surface. For this reason, in the example shown in (a) and (b) of FIG. 4, there is a cross-sectional shape in which a straight body part is formed between the laser light incidence surface and the laser light emission surface of which the cross-section is circular. In contrast, if a refractive index of a material forming the press member-cum-optical system 14 is close to 2.0, the straight body part is unnecessary, and thus a cross-sectional shape of the press member-cum-optical system 14 may be a circular shape (the circle C). A laser light collection position in this case may be formed around the surface of the press member-cum-optical system 14 and outside the circle C of the circular cross-section (outward by the thickness of the transparent belt 10) so as to collect laser light on the toner image T. In a case where a cross-sectional shape of the press member-cum-optical system 14 is a circular shape, the press member-cum-optical system 14 may be rotated along with movement of the transparent belt 10 shown in FIG. 1.

In addition, a cross-section of the laser light incidence surface and the laser light emission surface of the press member-cum-optical system 14 is not limited to the above-described circular shape, and any shape thereof may be available as long as it is a shape which enables laser light to be collected on the toner image T.

A material of the press member-cum-optical system 14 may be selected from heat-resistant materials among materials which are typically used for a lens, and may include, for example, a variety of optical glass, optical transparent plastic resins, or the like. As the optical transparent plastic resins, there may be materials including poly diethylene glycol bis allyl carbonate (PADC), polymethyl methacrylate (PMMA), polystyrene (PSt), polymers (MS resin) consisting of methyl methacrylate units and styrene units, a polycarbonate resin, a cycloolefin resin, a fluorene resin, and the like.

Figure 5:
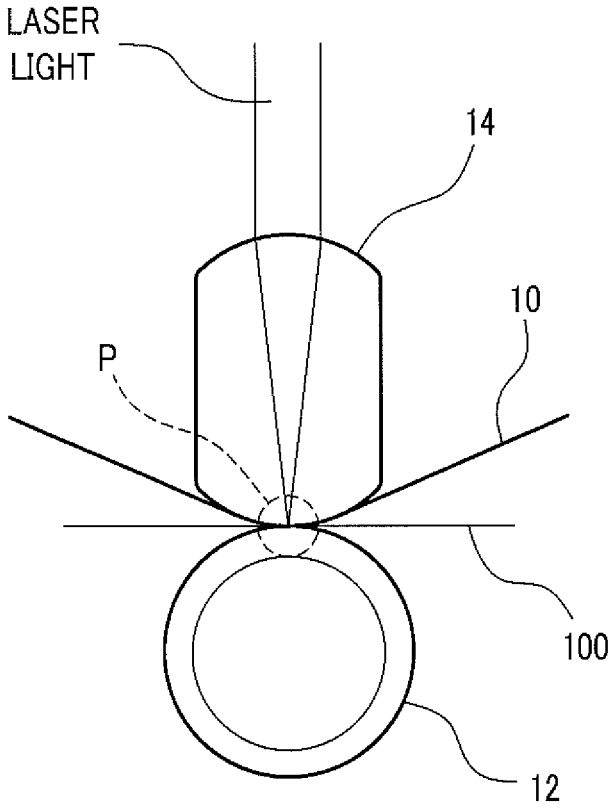
FIG. 5 is a diagram illustrating a function of the press member-cum-optical system according to the exemplary embodiment.

FIG. 5 is a diagram illustrating a function of the press member-cum-optical system 14. In FIG. 5, the press member-cum-optical system 14 contacts with the transparent belt 10 from the opposite side to the press roller 12, and forms the press region P for pressing the toner image T formed on the recording medium 100 transported in a state of being interposed between the transparent belt 10 and the press roller 12, in cooperation with the press roller 12. In the example of FIG. 5, the transparent belt 10 is slid on the surface of the press member-cum-optical system 14. In this case, if there is an air layer between the transparent belt 10 and the press member-cum-optical system 14, some of laser light is reflected at the respective interfaces. In order to prevent this reflection, a liquid such as a silicone oil is supplied to the inner surface (a surface on the press member-cum-optical system 14 side) of the transparent belt 10 such that there is no air layer therein. Thereby, it is possible to effectively use laser light emitted from the laser light irradiation unit 16.

The press member-cum-optical system 14 collects laser light so as to heat the toner image T while pressing the toner image T formed on the recording medium 100 in cooperation with the press roller 12 in the press region P. Accordingly, the toner image T is fixed onto the recording medium 100.

Figure 6A:
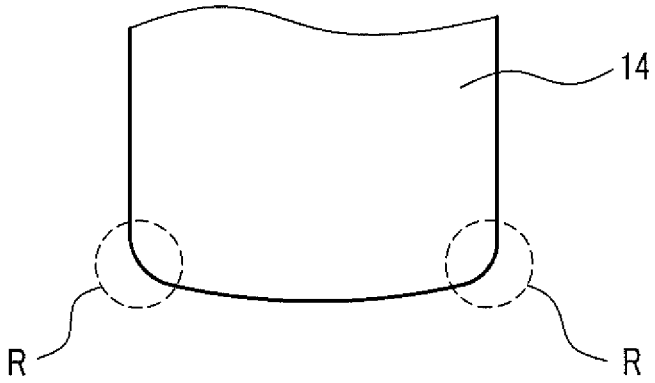
FIGS. 6A and 6B are cross-sectional views illustrating examples of a sliding surface between the press member-cum-optical system and the transparent belt according to the exemplary embodiment.
Figure 6B:
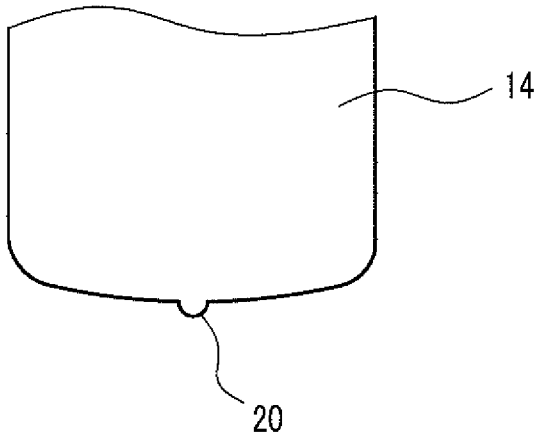

FIGS. 6A and 6B are cross-sectional views illustrating examples of a sliding surface (laser light emission surface) of the press member-cum-optical system 14 with the transparent belt 10. In FIG. 6A, curves with a curvature radius R are formed at both corners of the cross-section of the sliding surface in the transport direction of the recording medium 100. The curvature radius R is smaller than a curvature radius of the sliding surface of the press member-cum-optical system 14 and thus the transparent belt 10 does not contact with both corners of the cross-section of the sliding surface and smooth sliding may be performed. In addition, in the example of FIG. 6B, a protrusion 20 is formed on the sliding surface of the press member-cum-optical system 14 so as to increase a pressing force on the press roller 12 via the transparent belt 10. Accordingly, it is possible to perform fixing with a higher strength. Further, a position of the protrusion 20 is preferably, for example, a center of the sliding surface in the transport direction of the recording medium 100 but is not limited thereto.

Figure 7A:
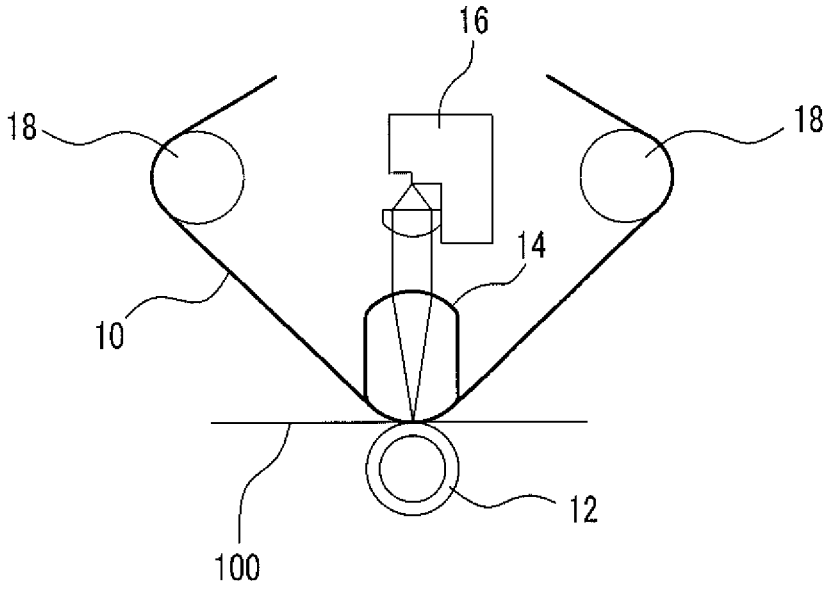
FIGS. 7A and 7B are diagrams illustrating examples of a method in which the transparent belt is slid on the press member-cum-optical system according to the exemplary embodiment.
Figure 7B:
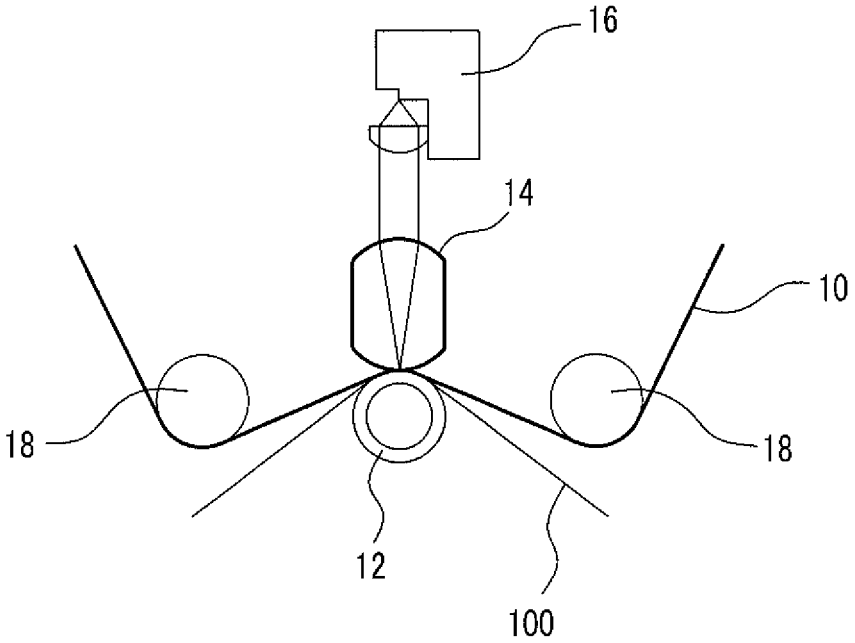

FIGS. 7A and 7B show examples of a method in which the transparent belt 10 is slid on the press member-cum-optical system 14. In the example of FIG. 7A, the transparent belt 10 is hung on the support rollers 18 such that pressure from the transparent belt 10 is mainly applied to the press member-cum-optical system 14 side. In addition, in the example of FIG. 7B, the transparent belt 10 is hung on the support rollers 18 such that pressure from the transparent belt 10 is mainly applied to the press roller 12 side. A sliding force (friction force) of the transparent belt 10 on the press member-cum-optical system 14 is smaller in the example of FIG. 7B than in the example of FIG. 7A. A method in which the transparent belt 10 is slid on the press member-cum-optical system 14 may be either one of the above-described methods, and may be appropriately determined based on a shape, a size, or the like of a fixing device.

Further, in the above-described exemplary embodiment, the toner image is formed on the recording medium in advance, and then, the recording medium is heated in the press region to fix the toner image. However, the present invention is not limited to such a case, and may be applied to a case described below.

Namely, the toner image is formed on the transparent belt and the recording medium is heated while being transported to the press region. Then, the toner image is simultaneously transferred and fixed at a desired site on the recording medium. In this case, it goes without saying that an image forming unit or a transferring unit that transfers a toner image formed by another image forming unit is provided at the upstream side of the press region of the transparent belt.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a transparent belt;

a press roller that is rotated with being opposed to and contacting with the transparent belt, and transports a recording medium interposed therebetween;

a press member-cum-optical system that contacts with the transparent belt from an opposite side to the press roller, forms a press region for pressing a toner image formed on the recording medium in cooperation with the press roller during transport of the recording medium, and collects laser light on the toner image in the press region in a transport direction of the recording medium; and a laser light irradiation unit that irradiates the press member-cum-optical system with laser light.

2. The fixing device according to claim 1, wherein a laser light incidence surface and a laser light emission surface of the press member-cum-optical system, in a cross-section parallel to the transport direction of the recording medium and perpendicular to a transport surface, have respectively circular shape, and a straight body part is formed between the laser light incidence surface and the laser light emission surface.

3. The fixing device according to claim 2, wherein both corners of the press member-cum-optical system, in a cross-section parallel to the transport direction of the recording medium and perpendicular to a transport surface, have respectively curve with a curvature radius smaller than a curvature radius of a laser light emission surface.

4. The fixing device according to claim 3, wherein a protrusion is formed on a surface on the press member-cum-optical system side of the transparent belt.

5. The fixing device according to claim 2, wherein a protrusion is formed on a surface on the press member-cum-optical system side of the transparent belt.

6. The fixing device according to claim 1, wherein both corners of the press member-cum-optical system, in a cross-section parallel to the transport direction of the recording medium and perpendicular to a transport surface, have respectively curve with a curvature radius smaller than a curvature radius of a laser light emission surface.

7. The fixing device according to claim 6, wherein a protrusion is formed on a surface on the press member-cum-optical system side of the transparent belt.

8. The fixing device according to claim 1, wherein a protrusion is formed on a surface on the press member-cum-optical system side of the transparent belt.

9. The fixing device according to claim 1, wherein a cross-section of the press member-cum-optical system that is parallel to the transport direction of the recording medium and is perpendicular to a transport surface is circular, and the press member-cum-optical system is rotated according to movement of the transparent belt.

10. The fixing device according to claim 1, wherein a liquid is supplied to a surface on the press member-cum-optical system side of the transparent belt.

11. The fixing device according to claim 1, wherein a protrusion is formed on a center of the sliding surface of the press member-cum-optical system.

* * * * *